US009878868B2

(12) United States Patent
Kobayashi et al.

(10) Patent No.: US 9,878,868 B2
(45) Date of Patent: Jan. 30, 2018

(54) IMAGE FORMING APPARATUS

(71) Applicants: Akihito Kobayashi, Nagoya (JP); Kohei Terada, Kiyosu (JP)

(72) Inventors: Akihito Kobayashi, Nagoya (JP); Kohei Terada, Kiyosu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/185,963

(22) Filed: Feb. 21, 2014

(65) Prior Publication Data

US 2014/0291920 A1 Oct. 2, 2014

(30) Foreign Application Priority Data

Mar. 29, 2013 (JP) ..... 2013-074395

(51) Int. Cl.
*B65H 31/26* (2006.01)
*B65H 29/52* (2006.01)
*B65H 31/02* (2006.01)

(52) U.S. Cl.
CPC ..... *B65H 31/26* (2013.01); *B65H 29/52* (2013.01); *B65H 31/02* (2013.01);
(Continued)

(58) Field of Classification Search
CPC ..... B65H 2301/4223; B65H 2301/421; B65H 31/26; B65H 2801/06; B65H 29/52
(Continued)

(56) References Cited

U.S. PATENT DOCUMENTS 3,630,517 A * 12/1971 Enskat ..... 271/220
4,824,091 A * 4/1989 Knight ..... B65H 29/22 271/178

(Continued)

FOREIGN PATENT DOCUMENTS

DE 3843281 * 6/1990
EP 0490272 * 6/1992

(Continued)

OTHER PUBLICATIONS

Japanese Office Action for Application No. 2013-074395 dated Feb. 7, 2017.

(Continued)

*Primary Examiner* — Thomas Morrison
(74) *Attorney, Agent, or Firm* — Haug Partners LLP

(57) ABSTRACT

An image forming apparatus includes: a discharging slot provided for discharging a recording medium on which an image is formed; a discharge tray including a supporting surface supporting the recording medium discharged from the discharging slot; a discharge mechanism configured to discharge the recording medium to the discharge tray through the discharging slot; and a press down mechanism including an abutting surface which is provided for pressing down the upper surface of the recording medium supported by the supporting surface of the discharge tray. The press down mechanism is rotatable about a rotation center provided on the upstream of the discharging slot in a discharge direction in which the recording medium is discharged from the discharging slot, and the abutting surface contacts with the supporting surface when no recording medium is supported by the discharge tray.

15 Claims, 10 Drawing Sheets

(52) U.S. Cl.
CPC ..... *B65H 2301/4212* (2013.01); *B65H 2301/51256* (2013.01); *B65H 2404/62* (2013.01); *B65H 2404/63* (2013.01); *B65H 2511/20* (2013.01); *B65H 2801/27* (2013.01)

(58) Field of Classification Search
USPC ..... 271/306, 207, 209, 220, 221
See application file for complete search history.

(56) References Cited

U.S. PATENT DOCUMENTS

| | | | | |
|---|---|---|---|---|
| 7,441,771 | B2 * | 10/2008 | Tamura et al. | 271/220 |
| 7,661,669 | B2 * | 2/2010 | Ichihashi et al. | 271/207 |
| 2006/0239735 | A1 * | 10/2006 | Ogata | G03G 15/6552 399/405 |
| 2007/0231036 | A1 * | 10/2007 | Fukatsu et al. | 399/407 |
| 2009/0127773 | A1 * | 5/2009 | Uchiyama et al. | 271/220 |
| 2009/0236798 | A1 * | 9/2009 | Kimura | B65H 31/38 271/221 |
| 2010/0096801 | A1 * | 4/2010 | Yanagida | 271/220 |
| 2010/0171256 | A1 * | 7/2010 | Ogata et al. | 270/58.02 |
| 2011/0042890 | A1 * | 2/2011 | Lee et al. | 271/314 |
| 2012/0049441 | A1 * | 3/2012 | Kimura | B65H 31/26 271/177 |

FOREIGN PATENT DOCUMENTS

| | | | |
|---|---|---|---|
| JP | 4-23764 | * | 1/1992 |
| JP | H04-88463 U | | 7/1992 |
| JP | H11-263511 | | 9/1999 |
| JP | 2002-370861 | | 12/2002 |
| JP | 2003-081515 | | 3/2003 |
| JP | 2004-307157 | | 11/2004 |
| JP | 2004-352425 | | 12/2004 |
| JP | 2006-306522 | | 11/2006 |
| JP | 2010-95365 | | 4/2010 |
| JP | 2012-250788 | | 12/2012 |

OTHER PUBLICATIONS

Japanese Office Action for Application No. 2013-074395 dated Apr. 25, 2017.

* cited by examiner

IMAGE FORMING APPARATUS

CROSS REFERENCE TO RELATED APPLICATION

The present application claims priority from Japanese Patent Application No. 2013-074395, which was filed on Mar. 29, 2013, the disclosure of which is incorporated herein by reference in its entirety.

BACKGROUND OF THE INVENTION

1. Field of the Invention

The present invention relates to an image forming apparatus configured to form an image on a recording medium and discharge the recording medium to a discharge tray.

2. Description of Related Art

It has been known that a recording medium on which an image is formed tends to curl. For example, a recording medium printed by an inkjet printer curls as the surface having absorbed the moisture of ink swells. On the other hand, a recording medium printed by an electrophotographic printer curls on account of the heat applied at the time of fixation. When such a curling recording medium is supported by a discharge tray, the recording medium discharging slot of the discharge tray is blocked and hence paper jam occurs. To prevent the occurrence of paper jam due to the curling of a recording medium, a known image forming apparatus has a press down unit which is configured to press down the recording medium supported by the discharge tray. Such a press down unit is arranged to be rotatable about a rotation center positioned above the discharge tray, and overlaps the discharge tray in plan view.

SUMMARY OF THE INVENTION

When correcting the curling of a recording medium by pressing down the same, the closer the point at which the recording medium is pressed down is to the edge of the recording medium, the more the correction is effective. In this regard, in the above-described image forming apparatus, when the rotation center of the rotating press down unit is provided to overlap the discharge tray in plan view, the point where the recording medium is pressed down by the press down unit tends to be away from the tail end of the recording medium as the number of recording media supported by the discharge tray increases, even if the rotation center of the press down unit is provided in the vicinity of the recording medium discharging slot of the discharge tray in order to press down the tail end of the recording medium.

Taking account of this disadvantage, an aspect of the present invention is to provide an image forming apparatus in which the curling of a recording medium supported by a discharge tray is effectively corrected.

An image forming apparatus according to an embodiment includes: a discharging slot provided for discharging a recording medium on which an image is formed; a discharge tray including a supporting surface supporting the recording medium discharged from the discharging slot; a discharge mechanism configured to discharge the recording medium to the discharge tray through the discharging slot; and a press down mechanism including an abutting surface which is provided for pressing down the upper surface of the recording medium supported by the supporting surface of the discharge tray, the press down mechanism being rotatable about a rotation center provided on the upstream of the discharging slot in a discharge direction in which the recording medium is discharged from the discharging slot, and the abutting surface contacting with the supporting surface when no recording medium is supported by the discharge tray.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following will describe First Embodiment with reference to figures.

Figure 1:
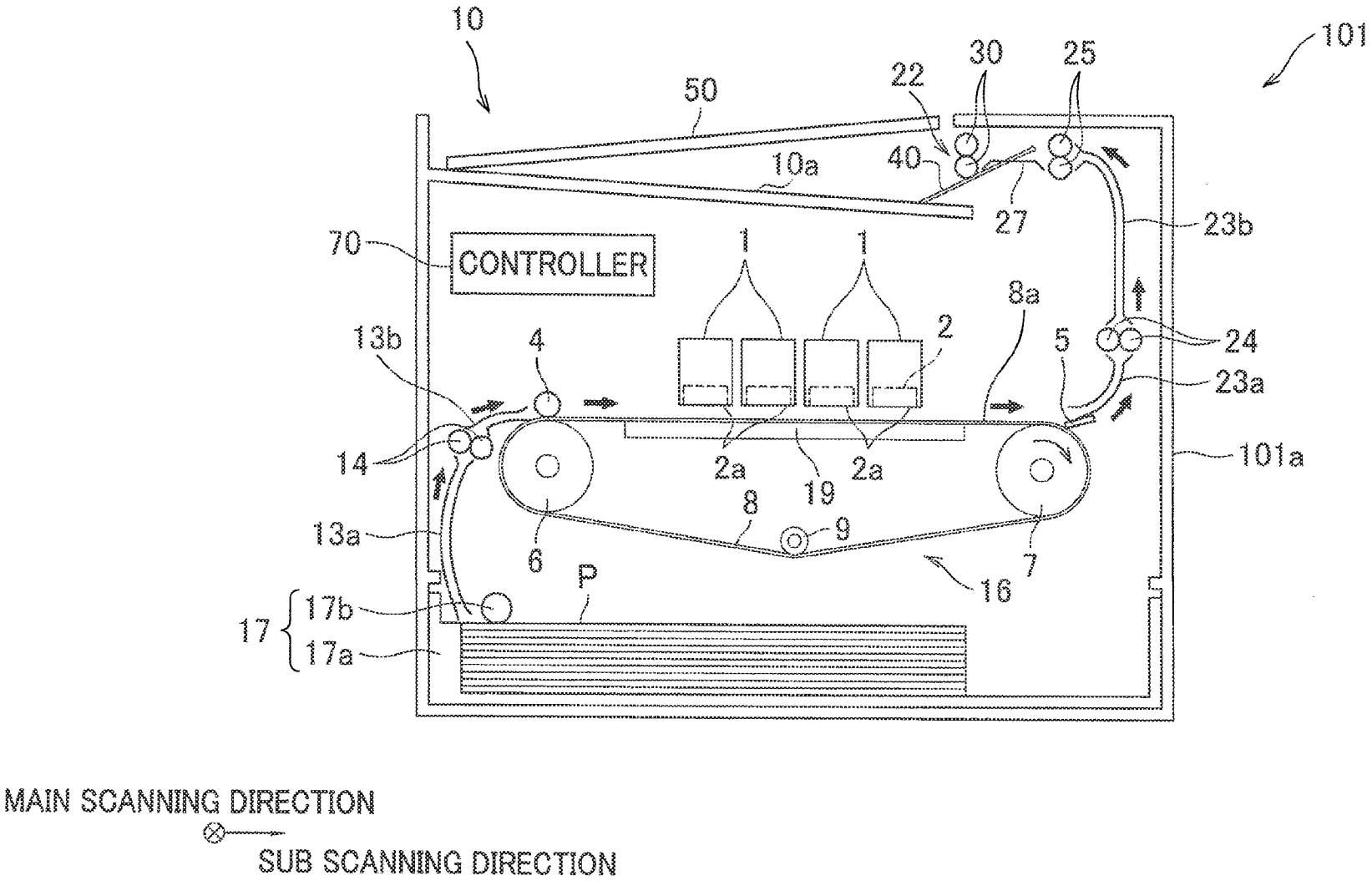
FIG. 1 is a schematic profile showing the overall structure of an inkjet printer of First Embodiment.

As shown in FIG. 1, an inkjet printer 101 of the present embodiment has a substantially rectangular parallelepiped housing 101*a*, and includes, in the housing 101*a*, four inkjet heads 1 which are lined up downward, a conveyance mechanism 16 which is configured to convey a sheet P in a conveyance direction (i.e., rightward in FIG. 1), and a sheet supply unit 17 which is configured to supply the sheet P. On the top plate of the housing 101*a*, a discharging slot 22 configured to discharge sheets P and a discharge tray 10 where the sheets P are discharged from the discharging slot 22 are provided. The discharge tray 10 is formed as a concave portion on the upper surface of the housing 101*a*, and its bottom functions as a supporting surface 10*a* supporting sheets P. The supporting surface 10*a* is inclined downward toward the discharging slot 22. Furthermore, a tail end press down unit 40 and a leading end press down unit 50 are provided for pressing down the sheet P supported by the supporting surface 10*a* of the discharge tray 10. In the housing 101*a*, a controller 70 is provided to control the overall operations of the printer 101.

Four inkjet heads 1 eject cyan, magenta, yellow, and black inks, respectively. Each of these inkjet heads 1 is substantially rectangular parallelepiped and long in the main scanning direction. The inkjet heads 1 are lined up along the conveyance direction of sheets P. To put it differently, the inkjet printer 101 is a line-type printer, and the main scanning direction is orthogonal to the conveyance direction. Each inkjet head 1 has a head main body 2 having, at its lower surface, an ejection surface 2*a* through which a plurality of unillustrated ejection openings are made through.

The conveyance mechanism 16 has two belt rollers 6 and 7, a conveyance belt 8, a tension roller 9, and a platen 19. The conveyance belt 8 is an endless belt wrapping between the rollers 6 and 7 and is tensioned by the tension roller 9. The platen 19 is provided in the region encircled by the conveyance belt 8, and supports the conveyance belt 8 at positions opposing the four inkjet heads 1. The belt roller 7 is a drive roller driven by a motor 61 (see FIG. 6). With this arrangement, the conveyance mechanism 16 drives the belt roller 7 so as to move the conveyance belt 8, with the result that a sheet P placed on the conveyance surface 8*a* of the conveyance belt 8 is conveyed.

The sheet supply unit 17 is detachably attached to the housing 101*a*, and includes a sheet feeding tray 17*a* housing a plurality of sheets P and a pickup roller 17*b* which is driven by a motor 62 (see FIG. 6) so as to send out the topmost sheet P in the sheet feeding tray 17*a*. The sheet P sent out from the sheet feeding tray 17*a* is forwarded to the conveyance mechanism 16 along guides 13*a* and 13*b* by a feed roller pair 14 which is driven by a motor 63 (see FIG. 6).

In the printer 101, a conveying path indicated by black arrows is formed as shown in FIG. 1. The sheet P sent from the lower sheet supply unit 17 to the conveyance mechanism 16 is pressed down onto the conveyance surface 8*a* by a press down roller 4. When the sheet P passes an opposing region opposing the ejection surface 2*a* of each inkjet head 1, a desired color image is formed on the upper surface of the sheet P. The sheet P on which the image has been formed is peeled off from the conveyance surface 8*a* by a peeling unit 5 provided immediately downstream of the conveyance mechanism 16, and is then conveyed upward along guides 23*a* and 23*b* by a feed roller pair 24 which is driven by a motor 64 (see FIG. 6). Furthermore, the sheet P is horizontally sent out by a feed roller pair 25 which is driven by a motor 65 (see FIG. 6) and conveyed while the lower surface is supported by a guide 27, and finally the sheet P is sandwiched between the rollers of an ejection roller pair 30 which is provided in the vicinity of the discharging slot 22 and driven by a motor 66 (see FIG. 6), and discharged through the discharging slot 22 toward a space which is vertically above the supporting surface 10*a* of the discharge tray 10. In the descriptions below, the direction in which a sheet P is discharged by the ejection roller pair 30 will be simply referred to as "discharge direction".

Figure 2:
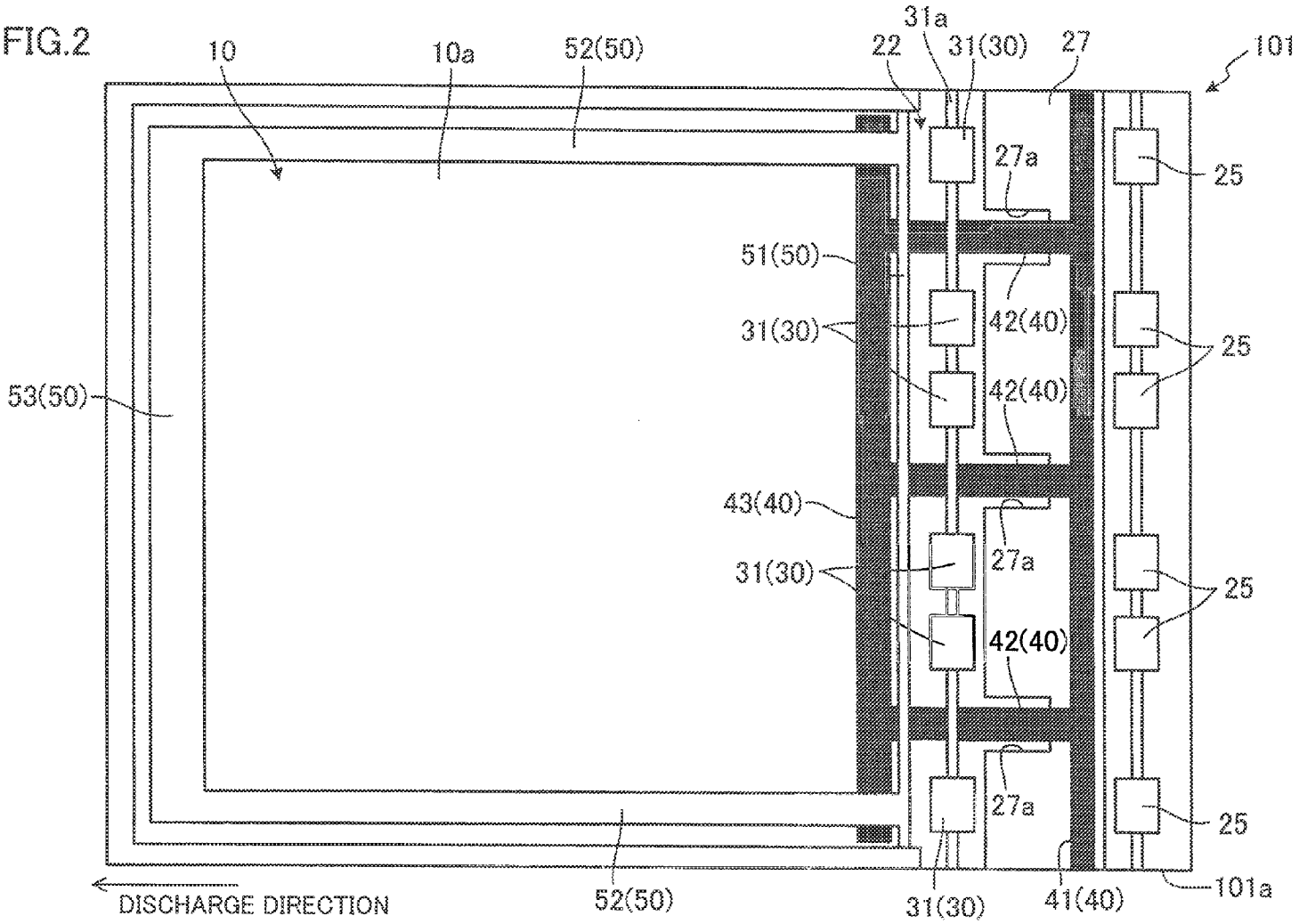
FIG. 2 shows the inkjet printer of FIG. 1 from above.

Now, referring further to FIGS. 2 and 3, the tail end press down unit 40 and the leading end press down unit 50 will be detailed. It is noted that, in FIG. 2 showing the inkjet printer 101 from above, a top plate is removed except at a part of the housing 101*a* where the discharge tray 10 is provided, for convenience of explanation.

The tail end press down unit 40 is supported by the inner wall of the housing 101*a* so as to be rotatable about a supporting shaft 41. The supporting shaft 41 extends in the direction orthogonal to the discharge direction in plan view (hereinafter, this direction will be simply referred to as the direction orthogonal to the discharge direction), and is on the upstream of the discharging slot 22 in the discharge direction and above the conveying path (indicated by dashed lines in FIG. 3A and FIG. 3B) of sheets P defined by the ejection roller pair 30. As shown in FIG. 2, the supporting shaft 41 is connected to three arms 42 which extend in the direction orthogonal to the length of the supporting shaft 41 and are provided at regular intervals. Each arm 42 is uniformly thick over the entire length and extends straight. The end portions of the three arms 42, which are on the opposite side to the supporting shaft 41, are connected to a single press down part 43 which extends in the direction orthogonal to the discharge direction.

Figure 3A:
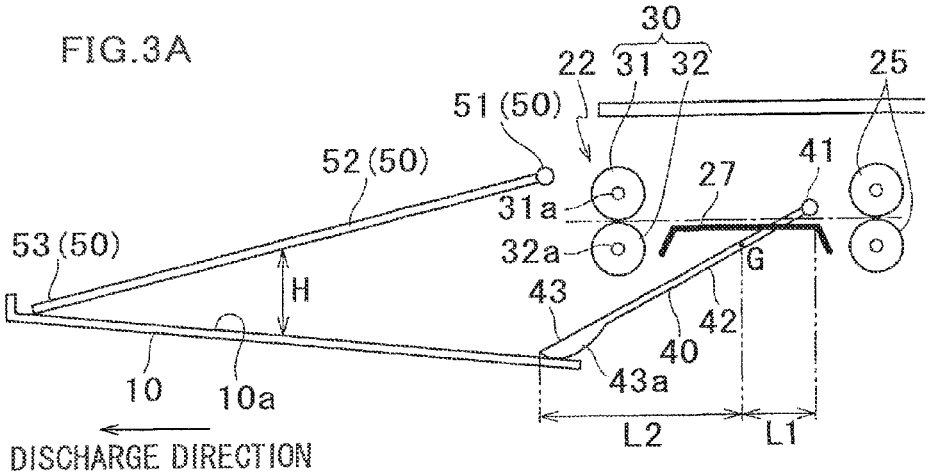
FIG. 3A illustrates the operations of the tail end press down unit and the leading end press down unit shown in FIG. 1, in which no sheet is supported by the discharge tray.
Figure 4A:
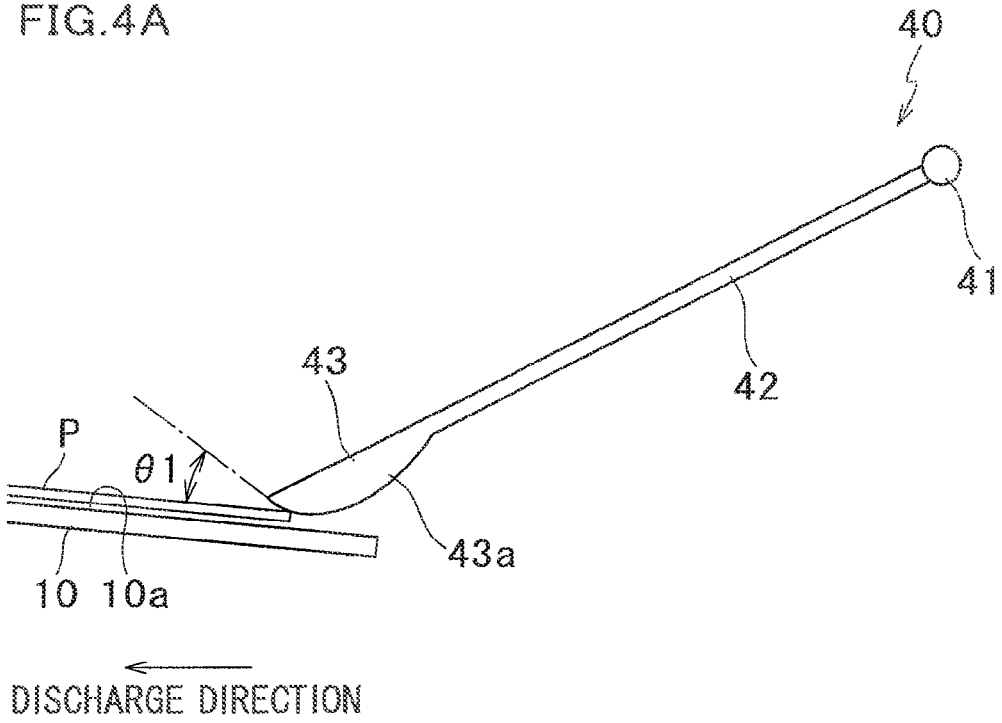
FIG. 4A shows an angle formed between the abutting surface of the tail end press down unit and the upper surface of the sheet.
Figure 4B:
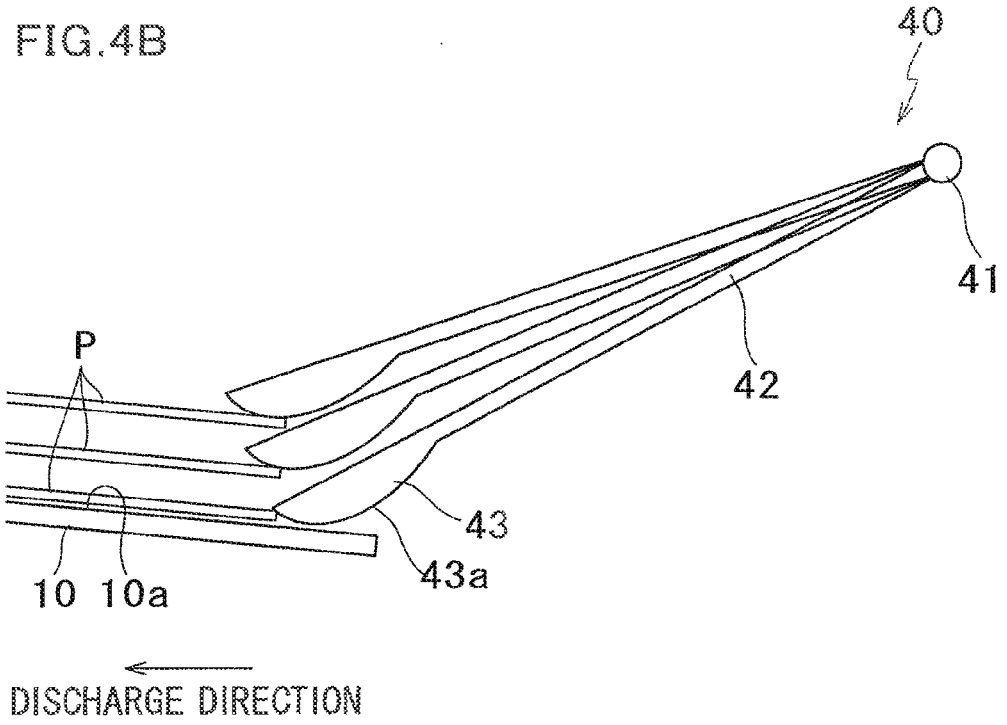
FIG. 4B shows the operation of the tail end press down unit which the discharge tray supports a large number of sheets.

The press down part 43 is disposed outside the housing 101*a*, and extends to reach the both opposite ends in the width direction of the supporting surface 10*a* of the discharge tray 10, in the width direction of the sheet P supported by the supporting surface 10*a* of the discharge tray 10. The lower surface of the press down part 43 is curved to protrude downward, so as to function as an abutting surface 43*a* which presses down an end of the upper surface of the sheet P supported by the supporting surface 10*a* of the discharge tray 10, which end is on the upstream in the discharge direction. As shown in FIG. 3A, the abutting surface 43*a* contacts with the supporting surface 10*a* of the discharge tray 10, when the discharge tray 10 does not support any sheet P. When the sheet P supported by the supporting surface 10*a* of the discharge tray 10 is pressed down, as shown in FIG. 4A, the angle $\theta_1$ formed by the abutting surface 43*a* and the upper surface of the sheet P is an acute angle. As shown in FIG. 4B, even if the number of sheets P supported on the discharge tray 10 is large, the abutting surface 43*a* always presses down the upstream end in the discharge direction of the upper surface of the sheet P.

The center of gravity of the tail end press down unit 40 is indicated as G in FIG. 3A. As shown in FIG. 3A, the length L1 from the center of gravity G to the supporting shaft 41 is shorter than the length L2 from the center of gravity G to the abutting surface 43*a*.

Figure 3B:
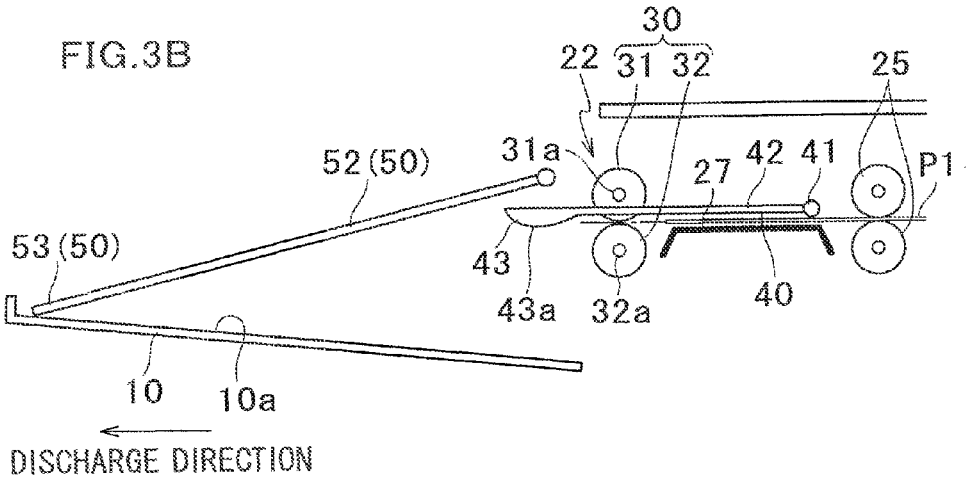
FIG. 3B illustrates the operations of the tail end press down unit and the leading end press down unit shown in FIG. 1, in which a sheet is being transported toward the discharging slot.
Figure 3C:
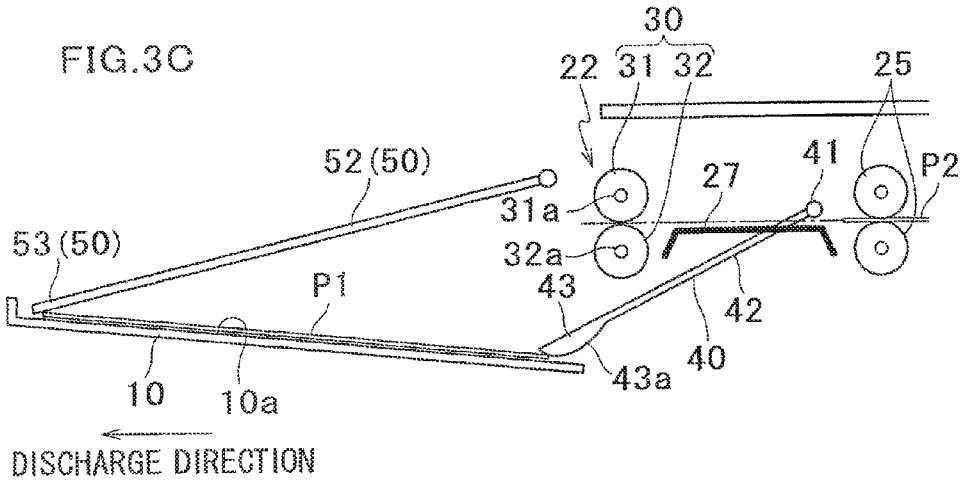
FIG. 3C illustrates the operations of the tail end press down unit and the leading end press down unit shown in FIG. 1, in which the sheet is supported by the discharge tray.

The tail end press down unit 40 is arranged such that, when the abutting surface 43*a* contacts with the supporting surface 10*a* of the discharge tray 10 as shown in FIG. 3A or contacts with the sheet P1 supported by the supporting surface 10*a* as shown in FIG. 3C, the arms 42 intersect with the conveying path of the sheets P formed by the ejection roller pair 30. When the sheet P1 is supplied to the surface of the guide 27 by the feed roller pair 25, the arms 42 are pushed on account of the contact with the sheet P1, with the result that the tail end press down unit 40 rotates upward (away from the supporting surface 10*a*) as shown in FIG. 3B. As shown in FIG. 2, the guide 27 has a notch 27*a* which is provided to avoid the interference with the rotating tail end press down unit 40.

As shown in FIG. 2, first ejection rollers 31 of the ejection roller pair 30, which are above the conveying path, are provided on a single roller shaft 31*a* which extends in the direction orthogonal to the discharge direction. The both ends of the roller shaft 31*a* are rotatably supported by the inner wall surfaces of the housing 101*a*. On the other hand, second ejection rollers 32 of the ejection roller pair 30, which are below the conveying path, are provided on roller shafts 32*a* (see FIG. 3A and FIG. 3B) in a similar manner as the first ejection rollers 31. The roller shafts 32*a* having the second ejection rollers 32, however, are plural in number and distanced from one another in the direction orthogonal to the discharge direction, to avoid the interference with the rotating tail end press down unit 40.

With the arrangement above, the tail end press down unit 40 having rotated upward as shown in FIG. 3B passes a gap between the roller shafts 32*a* each having the second ejection rollers 32, and contacts with the first ejection rollers 31 of the roller shaft 31*a*. At this stage, the entirety of the tail end press down unit 40 is above the conveying path formed by the ejection roller pair 30. The sheet P1 having pushed up the tail end press down unit 40 passes below the tail end press down unit 40 while being supported by the guide 27 at its lower surface, and is then discharged to the discharge tray 10 through the discharging slot 22.

As shown in FIG. 3C, when sheets P1 and P2 are serially discharged through the discharging slot 22, the tail end press down unit 40 contacts with the sheet P1 after the sheet P1 which is discharged first is supported by the discharge tray 10 and before the sheet P2 which is subsequently discharged is supported the discharge tray 10. That is to say, provided that the time from the contact of the first sheet P1 with the arms 42 of the tail end press down unit 40 on the conveying path to the contact of the second sheet P2 with the arms 42 of the tail end press down unit 40 on the conveying path is $t_0$, the time from the contact of the first sheet P1 with the arms 42 of the tail end press down unit 40 on the conveying path to the time point at which the sheet P1 leave the ejection roller pair 30 is $t_1$, and the time from the leaving of the first sheet P1 from the ejection roller pair 30 to the time point at which the tail end press down unit 40 rotating downward (toward the sheet P supported by the supporting surface 10*a*) contacts with the sheet P1 is $t_2$, the time T during which the tail end press down unit 40 presses down the first sheet P1 is represented by the following equation (1).

$$T=t_0-t_1-t_2 \quad (1)$$

In this regard, the time $t_0$ from the contact of the first sheet P1 with the arms 42 to the contact of the second sheet P2 with the arms 42 is determined by the conveyance speed of each of the sheets P1 and P2 and the distance between the sheets P1 and P2. The time $t_1$ until the first sheet P1 leaves the ejection roller pair 30 is determined by the conveyance speed of the sheet P1. In other words, the press-down time T of the sheet P1 represented by the equation (1) is varied by changing the conveyance speed of each of the sheets P1 and P2 and/or the distance between the sheets P1 and P2. For the reason above, the conveyance speed of each of the sheets P1 and P2 and/or the distance between the sheets P1 and P2 is adjusted by the controller 70 so that, for example, the press-down time T is adjusted to be tong for sheets which easily curl due to high-duty printing (i.e., sheets on each of which a region where ink droplets hit occupies a large part thereof).

The leading end press down unit 50 is supported on the inner side of the side wall of the discharge tray 10 so as to be rotatable about the supporting shaft 51. The supporting shaft 51 extends in a direction orthogonal to the discharge direction and is disposed on the downstream in the discharge direction of the discharging slot 22 and above the tail end press down unit 40 contacting with the roller shaft 31*a* of the first ejection roller 31, as shown in FIG. 3B. As shown in FIG. 2, with around the respective end portions of the supporting shaft 51, arms 52 are connected to extend in the direction orthogonal to the length of the supporting shaft 51 (i.e., orthogonal to the width direction of the sheet P supported by the supporting surface 10*a* of the discharge tray 10). The end portions of the three arms 42, which are on the opposite side to the supporting shaft 41, are connected to a single press down part 43 which extends in the direction orthogonal to the discharge direction. The distance H (see FIG. 3A) between the leading end press down unit 50 and the supporting surface 10*a* of the discharge tray 10 increases toward the upstream in the discharge direction (i.e., rightward in FIG. 3A).

Figure 5:
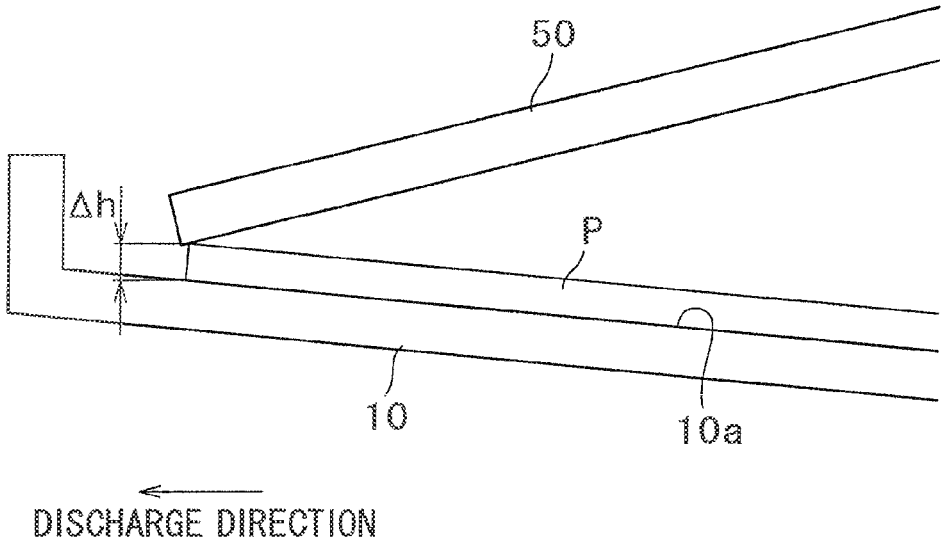
FIG. 5 is an enlarged view of a part of the sheet, at which part the sheet is pressed down by the leading end press down unit.

The leading end press down unit 50 rotates about the supporting shaft 51 so that the downstream end portion thereof in the discharge direction moves toward and away from the supporting surface 10*a* of the discharge tray 10. As shown in FIG. 3A, when no sheet P is supported by the discharge tray 10, the downstream end in the discharge direction of the leading end press down unit 50 contacts with the downstream end portion of the supporting surface 10*a* of the discharge tray 10. As shown in FIG. 3C, the leading end press down unit 50 moves upward (away from the supporting surface 10*a*) as it contacts with the downstream end in the discharge direction of the sheet P discharged onto the discharge tray 10. That is to say, at this stage, the downstream end of the leading end press down unit 50 floats off from the supporting surface 10*a*. More specifically, as shown in FIG. 5, the leading end press down unit 50 contacts only with the upper edge of the downstream end in the discharge direction of the sheet P supported by the supporting surface 10*a* of the discharge tray 10, so as to apply its own weight to the upper edge of the downstream end.

The controller 70 controls the motor 66 which drives the ejection roller pair 30 so that the sheet P is discharged onto the discharge tray 10 at a speed with which the kinetic energy of the sheet P discharged onto the discharge tray 10 is not smaller than the energy required to move the leading end press down unit 50 upward (away from the supporting surface 10*a*) by the height Δh (see FIG. 5) which is equivalent to one sheet P1 (and also controls, when necessary, the motor 64 driving the feed roller pair 24 and the motor 65 driving the feed roller pair 25).

Figure 6:
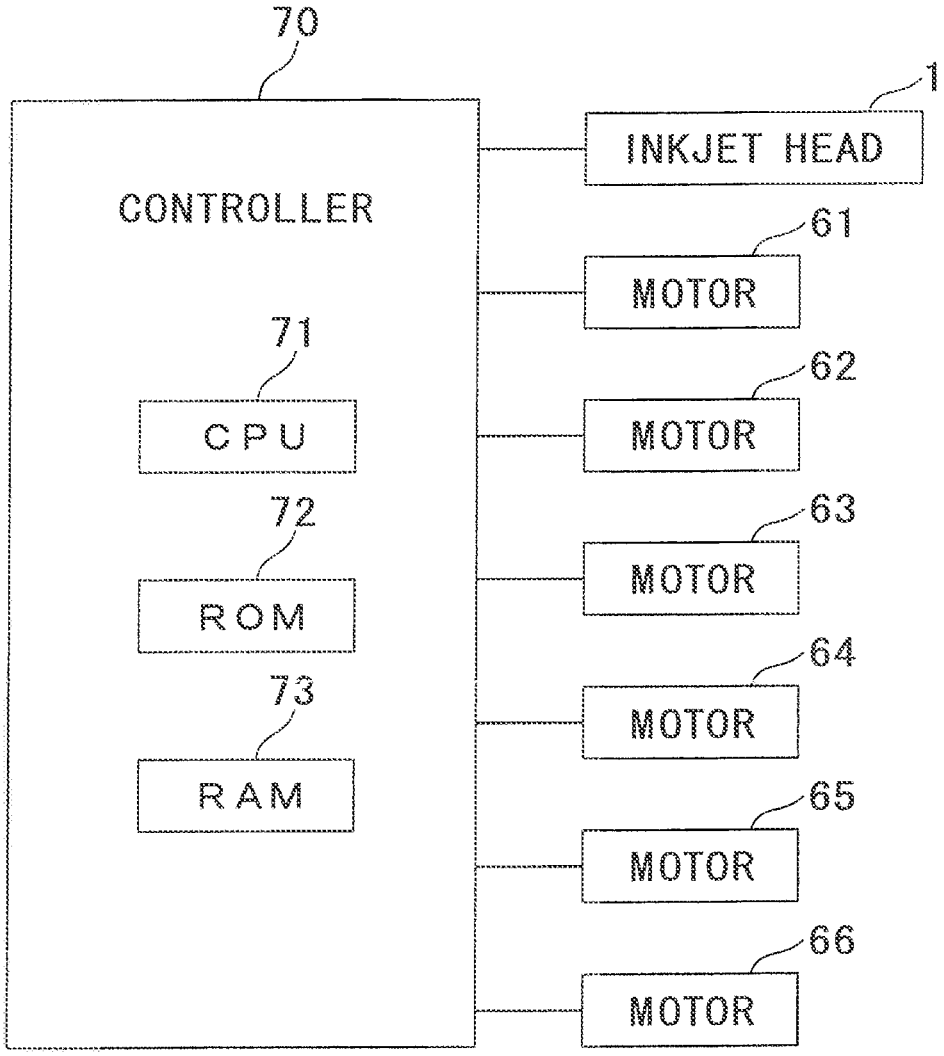
FIG. 6 is a functional block diagram of the controller of FIG. 1.

Now, the controller 70 will be described with reference to FIG. 6. The controller 70 includes a CPU (Central Processing Unit) 71, a ROM (Read Only Memory) 72, and a RAM (Random Access Memory) 73. Furthermore, the controller 70 is connected to various devices, driving units, and sensors of the inkjet printer 101 such as the four inkjet heads 1 and the motors 61 to 66.

The ROM 72 stores firmware which controls programs for controlling the inkjet printer 101 and various settings. The image formation on sheets P and the control of conveyance and discharge of sheets P are achieved as the firmware is executed by the CPU 71. The RAM 73 is used as a work area to which control programs are read or as a memory area where data is temporarily stored.

As described above, in the inkjet printer 101 of the present embodiment, the tail end press down unit 40 including the abutting surface 43*a* provided for pressing down the upper surface of the sheet P supported by the supporting surface 10*a* of the discharge tray 10 is rotatable about the supporting shaft 41 which is provided upstream of the discharging slot 22 in the discharge direction, and the abutting surface 43*a* contacts with the supporting surface 10*a* when no sheet P is supported by the discharge tray 10. The tail end press down unit 40 is therefore elongated as compared to cases where the supporting shaft 41 of the tail end press down unit 40 is provided to overlap the discharge tray 10 in plan view. With this, the point of pressing down the sheet P does not easily change even if the number of sheets P supported by the discharge tray 10 becomes large. Therefore the point at which the topmost sheet P is pressed down by the tail end press down unit 40 is not deviated from the end portion, and hence the curling of the sheet P supported by the discharge tray 10 is effectively corrected.

In addition to the above, in the inkjet printer 101 of the present embodiment, when the sheets P1 and P2 are serially discharged from the discharging slot 22, the tail end press down unit 40 contacts with the sheet P1 after the sheet P1 discharged first is supported by the discharge tray 10 and before the sheet P2 discharged second is supported by the discharge tray 10. As such, the sheets P are pressed down each time a single sheet is discharged. This makes it possible to further effectively correct the curling of the sheet P supported by the discharge tray 10.

In addition to the above, in the inkjet printer 101 of the present embodiment, the tail end press down unit 40 is arranged so that its supporting shaft 41 is provided above the conveying path of the sheet P formed by the ejection roller pair 30, and the arms 42 intersect with the conveying path. Therefore, as the sheet P conveyed along the conveying path contacts with the tail end press down unit 40, the tail end press down unit 40 rotates to move away from the sheet P, and then the sheet P supported by the supporting surface 10*a* of the discharge tray 10 is pressed down. In other words, because the tail end press down unit 40 is lifted by the kinetic energy of the discharged sheet P, it is unnecessary to additionally provide a power source for lifting the tail end press down unit 40. The structure of the tail end press down unit 40 is therefore simplified.

In addition to the above, in the inkjet printer 101 of the present embodiment, on the upstream in the discharge direction of the ejection roller pair 30, the guide 27 is provided to support the lower surface of the sheet P. This prevents the discharged sheet P from deviating from the conveying path and being pushed out downward, when the sheet P contacts with the tail end press down unit 40.

In addition to the above, in the inkjet printer 101 of the present embodiment, the abutting surface 43*a* extends to reach the both opposite ends of the supporting surface 10*a* in the width direction, in the width direction of the sheet P supported by the supporting surface 10*a* of the discharge tray 10. With this, the rear end portions in the conveyance direction of variously-sized sheets P supported by the discharge tray 10 are pressed down over the entire length.

In addition to the above, in the inkjet printer 101 of the present embodiment, when the tail end press down unit 40 rotates upward, this unit contacts with the roller shaft 31*a* of the first ejection roller 31. In other words, the roller shaft 31*a* functions as a stopper for stopping the rotation of the tail end press down unit 40 away from the sheet P. When contacting with the roller shaft 31*a*, the tail end press down unit 40 drops after the sheet P is discharged, without rotating excessively. This makes it possible to elongate the time T of pressing down the sheet P.

In addition to the above, in the inkjet printer 101 of the present embodiment, the tail end press down unit 40 is arranged such that the length L1 from the center of gravity G of the unit 40 to the supporting shaft 41 is shorter than the length L2 from the center of gravity G to the abutting surface 43*a*. This arrangement reduces the moment of inertia of the tail can press down unit 40 as compared to cases where the center of gravity is close to the abutting surface 43*a*, with the result that the dropping speed of the tail end press down unit 40 is increased. This makes it possible to elongate the time T of pressing down the sheet P.

In addition to the above, in the inkjet printer 101 of the present embodiment, the abutting surface 43*a* of the tail end press down unit 40 is curved. With this arrangement, because the point at which the sheet P contacts with the abutting surface 43*a* remains almost unchanged even if the number of sheets P supported by the discharge tray 10 varies, the end portion of the sheet P is kept pressed down. Furthermore, it is possible to prevent a corner of the tail end press down unit 40 from colliding with the sheet P.

In addition to the above, in the inkjet printer 101 of the present embodiment, the abutting surface 43*a* of the tail end press down unit 40 contacts with the upstream end in the discharge direction of the upper surface of the sheet P and the angle formed by the surface 43*a* and the upper surface of the sheet P is an acute angle. With this, even if the number of sheets P supported by the discharge tray 10 varies, the abutting surface 10*a* keeps pressing down the upstream end of the sheet P, with the result that the curling is further effectively corrected.

Figure 7:
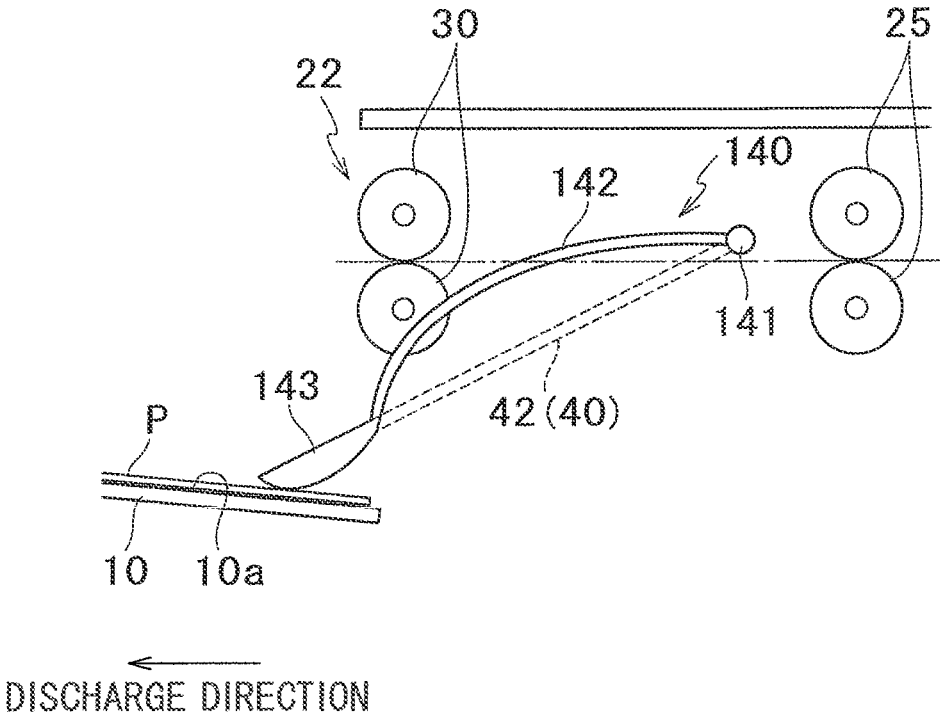
FIG. 7 shows a tail end press down unit of a variation.

Now, a variation of the present embodiment will be described. In the variation shown in FIG. 7, the shape, of each arm 42 provided between the supporting shaft 41 and the press down part 43 of the tail end press down unit 40 of the embodiment above is changed. An arm 142 of the tail end press down unit 140 of the variation is curved upward, the apex of the curve being located between the supporting shaft 141 and the press down part 143. The arm 142 intersects with the conveying path of the sheet P formed by the ejection roller pair 30, when the sheet P discharged onto the discharge tray 10 is being pressed down.

According to the variation, as compared to the embodiment above in which each arm 42 extends straight as in the tail end press down unit 40 (indicated by the broken lines in FIG. 7), the intersection between the tail end press down unit 140 and the conveying path of the sheet P (i.e., the contact position with the sheet P) is on the downstream in the discharge direction. This makes it possible to elongate the time T of pressing down the sheet P. Furthermore, a part of the arm 142 at which part the arm contacts with the sheet P is formed as a curved surface. Because this decreases the contact angle formed by the arm 142 and the sheet P, the sheet P does not severely collide with the arm 142, and hence the occurrence of paper jam is restrained.

Figure 8A:
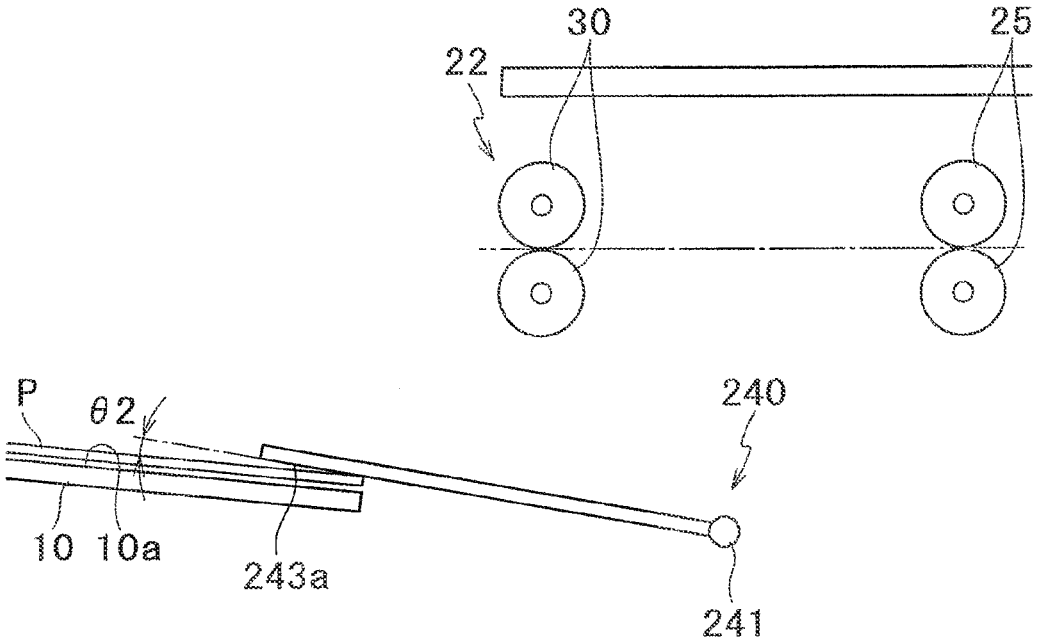
FIG. 8A shows an angle formed by the abutting surface of the tail end press down unit and the upper surface of the sheet in the variation.

In the embodiment above, the supporting shaft 41 of the tail end press down unit 40 is above the conveying path of the sheet P formed by the ejection roller pair 30. The disclosure, however, is not limited to this arrangement. Alternatively, according to the variation shown in FIGS. 8A and 8B, a supporting shaft 241 of the tail end press down unit 240 is below the conveying path. Furthermore, while in the embodiment above the abutting surface 43*a* of the tail end press down unit 40 for pressing down the sheet P is a curved surface, in the tail end press down unit 240 of the variation the abutting surface 243*a* is a flat surface.

It is noted that the tail end press down unit 240 of the variation is moved by a motor (not illustrated). That is to say, before the sheet P is sent out from the ejection roller pair 30, the tail end press down unit 240 is rotated away from the supporting surface 10*a* by the motor. Subsequently, after the sheet P is supported by the supporting surface 10*a* of the discharge tray 10, the tail end press down unit 240 is rotated toward the supporting surface 10*a* by the motor, and the sheet P is pressed down by the tail end press down unit 240. The rotation of the tail end press down unit 240 may be done by a method other than the driving of the motor. That is to say, though illustration is omitted, an arm branching off from the tail end press down unit 240 may be provided to intersect with the conveying path of the sheet P, and the tail end press down unit 240 may be rotated by causing a conveyed sheet P to collide with the arm.

According to the variation, the supporting shaft 241 of the tail end press down unit 240 is provided in proximity to the upper surface of the sheet P in the vertical direction. For this reason, the point at which the sheet P is pressed down is hardly changed even if the number of sheets P supported by the discharge tray 10 is increased. To prevent the deviation of the point of pressing down the sheet P, the supporting shaft 241 of the tail end press down unit 240 is preferably at the same height as the sheet P supported by the supporting surface 10*a* of the discharge tray 10.

Figure 8B:
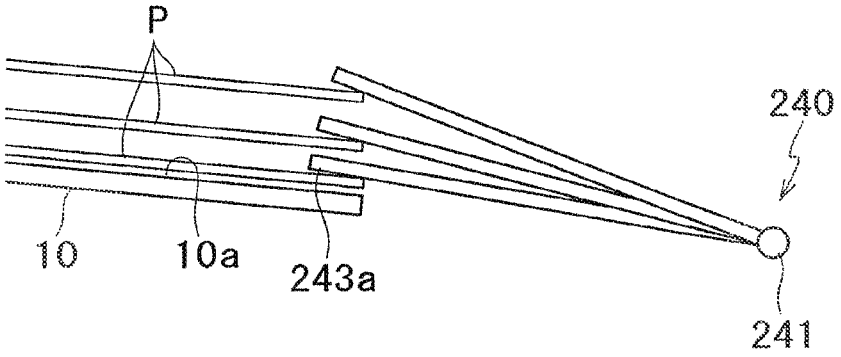
FIG. 8B shows the movement of the tail end press down unit shown in FIG. 8A.

In the tail end press down unit 240 of the variation, in the same manner as in the embodiment above, the abutting surface 243*a* contacts with the upstream end in the discharge direction of the upper surface of the sheet P and the angle $\theta_2$ formed by the abutting surface 243*a* and the upper surface of the sheet P is an acute angle (see FIG. 8A), For this reason, as shown in FIG. 8B, even if the number of sheets P supported by the discharge tray 10 is increased, the abutting surface 243*a* of the tail end press down unit 240 keeps pressing down the upstream end of the sheet P, and hence the curling of the sheet P is further effectively corrected.

Figure 9:
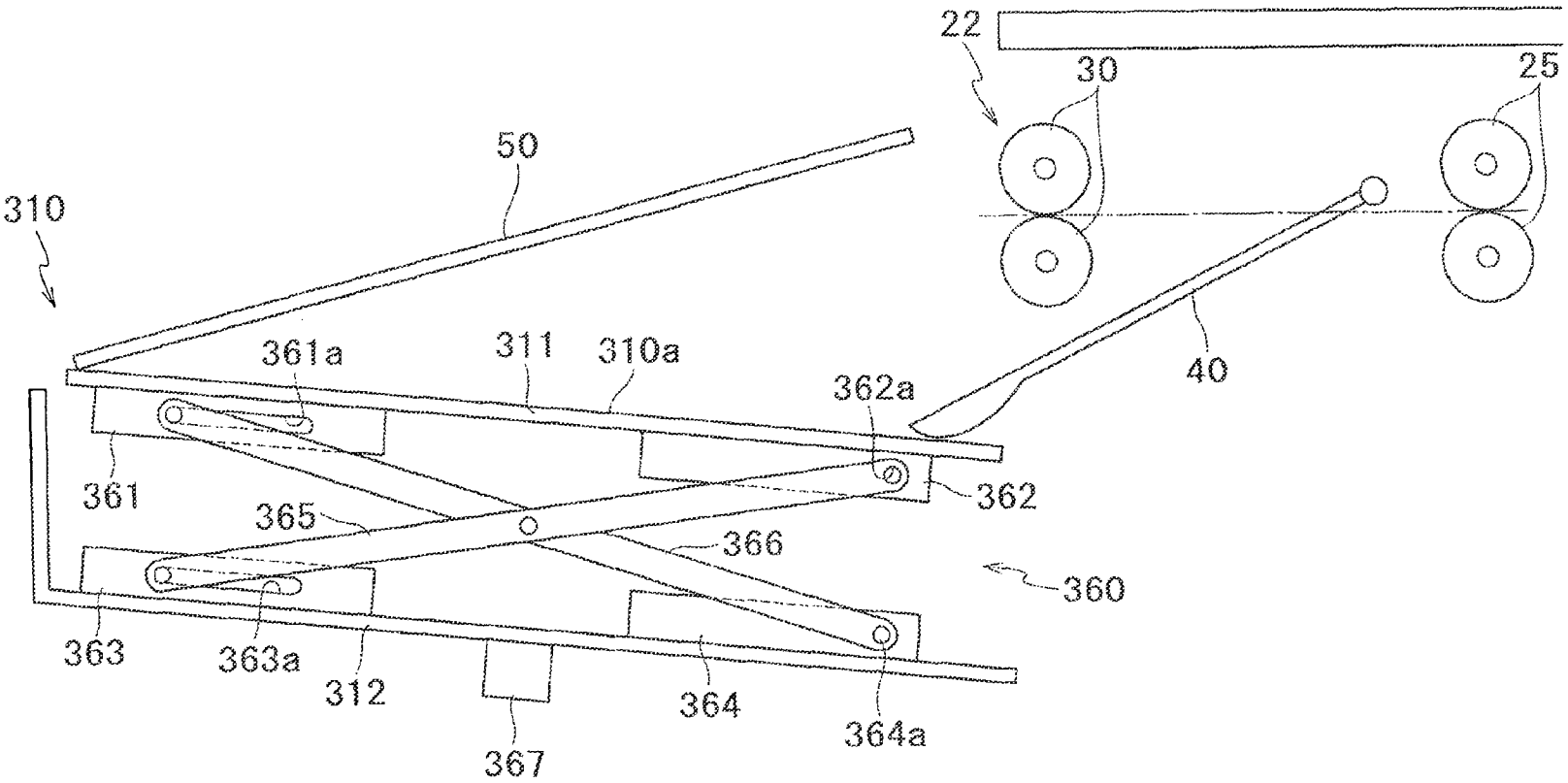
FIG. 9 shows a discharge tray of a variation.
Figure 10:
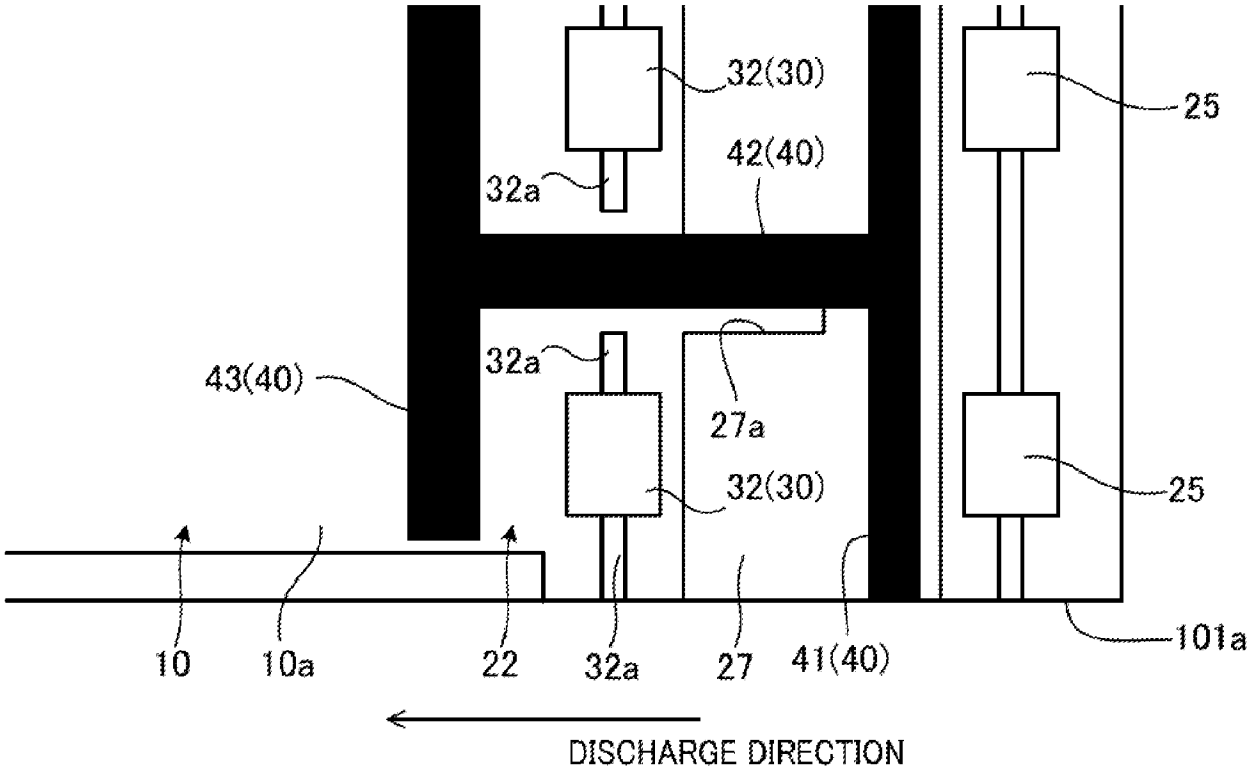
FIG. 10 is an above view like FIG. 2, but shows a partial enlarged view of one arm and two neighboring second ejection rollers 32 of the ejection roller pairs 30, which are located below the first ejection rollers 31.

Furthermore, as shown in FIG. 9, in a discharge tray 310 of a variation, a supporter 311 having an upper surface functioning as a supporting surface 310*a* supporting a sheet P is provided in a concave tray main body 312, and a moving mechanism 360 is provided to move the supporter 311 in vertical directions.

The moving mechanism 360 includes flanges 361 and 362 provided on the lower surface side of the supporter 311, flanges 363 and 364 provided in a similar manner on the bottom of the tray main body 312 to symmetrically oppose the flanges 361 and 362, and connection members 365 and 366 rotatably connected to the flanges 361 to 364. The flanges 361 to 364 have through holes 361*a* to 364*a*, respectively, and are connected with the connection members 365 and 366 at the respective holes. The through holes 361*a* and 363*a* made through the respective flanges 361 and 363 are oblong holes which are in parallel to the supporting surface 310*a*. The connection member 365 is connected with the through holes 362*a* and 363*a* of the flanges 362 and 363 by shafts at the respective end portions, whereas the connection member 366 is connected with the through holes 361*a* and 364*a* of the flanges 361 and 364 by shafts at the respective end portions. The connection member 365 and the connection member 366 are connected with each other at substantial centers thereof. On the lower surface of the tray main body 312 is provided a motor 367. This motor 367 is connected with an unillustrated mechanism which is configured to move the shaft connecting the connection member 365 with the flange 363, in the directions in parallel to the length of the through hole 363*a*. With this arrangement, as the motor 367 is driven and the shaft connecting the connection member 365 with the flange 363 is moved along the oblong through hole 363*a*, the supporter 311 is vertically moved on account of the linking mechanism constituted by the flanges 361 to 364 and the connection members 365 and 366.

In the variation, by moving the supporting surface 310*a* up and down, it is possible to change the time $t_2$ which elapses until the tail end press down unit 40 rotates downward (toward the sheet P supported by the supporting surface 310*a*) after the preceding sheet P1 has passed the ejection roller pair 30 and contacts with the sheet P1. In other words, the time T of pressing down the sheet P1 represented by the equation (1) is changeable by changing the vertical position of the supporting surface 310*a*.

In the embodiment above, when sheets P1 and P2 are serially discharged from the discharging slot 22, the tail end press down unit 40 contacts with the sheet P1 after the sheet P1 discharged first is supported by the discharge tray 10 and before the sheet P2 discharged second is supported by the discharge tray 10. The disclosure, however, is not limited to this arrangement. Alternatively, for example, when the sheet P1 discharged first rarely curls because of relatively low-duty printing, the conveyance speed of each of the sheets P1 and P2 and/or the distance between the sheets P1 and P2 may be adjusted so that the tail end press down unit 40 does not contact with the sheet P1 before the sheet P2 discharged second is supported by the discharge tray 10, i.e., the time T of pressing down represented by the equation (1) above is 0 or shorter.

In addition to the above, while in the embodiment above the guide 27 supporting the lower surface of the sheet P is provided on the upstream in the discharge direction of the ejection roller pair 30, the guide 27 may not be provided.

In addition to the above, the embodiment above is arranged such that the abutting surface 43*a* extends to reach the both opposite ends in the width direction of the supporting surface 10*a* in the width direction of the sheet P supported by the supporting surface 10*a* of the discharge tray 10. The disclosure, however, is not limited to this arrangement. Alternatively, for example, the abutting surface 43*a* may extend to reach the both opposite ends in the width direction of the largest sheet P used in the printer 101. The abutting surface 43*a* may be differently arranged as long as it is able to contact with at least a part in the width direction of the sheet P supported by the supporting surface 10*a*.

In addition to the above, the embodiment above is arranged so that the tail end press down unit 40 contacts with the roller shaft 31*a* of the first ejection roller 31 when rotating upward. The disclosure, however, is not limited to this arrangement. Instead of the roller shaft 31*a*, a member functioning as a stopper may be provided to contact with the tail end press down unit 40 when the tail end press down unit 40 rotates upward. Alternatively, such a stopper may not be provided at all.

While in the embodiment above the tail end press down unit 40 is arranged so that the length L1 from the center of gravity G of the unit to the supporting shaft 41 is shorter than the length L2 from the center of gravity G to the abutting surface 43*a*, the center of gravity of the tail end press down unit 40 may be differently arranged.

In addition to the above, the embodiment above is arranged so that the abutting surface 43*a* of the tail end press down unit 40 contacts with the upstream end in the discharge direction of the upper surface of the sheet P and the angle formed by the abutting surface 43*a* and the upper surface of the sheet P is an acute angle. The disclosure, however, is not limited to this arrangement. That is to say, the abutting surface 43*a* of the tail end press down unit 40 may be differently arranged as long as it contacts with an upstream end portion in the discharge direction of the upper surface of the sheet P, and the angle formed by the surface 43*a* and the upper surface of the sheet P may be an obtuse angle.

In addition to the above, while in the embodiment above the present invention is employed in the inkjet printer 101 which forms images by discharging ink, image forming apparatuses in which the present invention is employable are not limited to this printer. For example, the present invention may be employed in an electrophotographic printer.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image forming apparatus comprising:

a discharging slot configured to allow the discharge of a recording medium on which an image is formed;

a discharge tray which includes a supporting surface configured to support the recording medium discharged from the discharging slot;

a discharge mechanism configured to discharge the recording medium to the discharge tray through the discharging slot and an ejection roller pair which is configured to sandwich the recording medium and eject the recording medium through the discharging slot; and a press down mechanism comprising:

one press down part including an abutting surface configured to press down an upper surface of the recording medium when the recording medium is supported by the supporting surface of the discharge tray; and at least two arms connected to the one press down part;

wherein the discharge mechanism includes:

a conveying path for conveying the recording medium toward the discharging slot; and a guide that constitutes a lower surface of the conveying path and supports a lower surface of the recording medium;

wherein the press down mechanism is rotatable about a rotation center provided vertically above the conveying path and upstream of the discharging slot in a discharge direction in which the recording medium is discharged from the discharging slot;

wherein the abutting surface contacts with the supporting surface when no recording medium is supported by the discharge tray;

wherein each arm of the press down mechanism includes:

an extending part which extends from the rotation center to reach the one press down part; and a leading end that is connected to the one press down part;

wherein the one press down part uninterruptedly extends from one end to an other end of the supporting surface of the discharge tray in a direction that is parallel to a width direction of the recording medium supported by the supporting surface of the discharge tray and is orthogonal to the discharge direction;

wherein the extending part of each arm intersects with a part of the conveying path that is upstream of the ejection roller pair, when the press down mechanism presses down the recording medium; and wherein at least one notch is formed in the guide so that the guide does not interfere with the arms when the one press down part presses down the upper surface of the recording medium supported by the supporting surface of the discharge tray.

2. The image forming apparatus according to claim 1;

wherein, when recording media are serially discharged from the discharging slot, the press down mechanism contacts with a recording medium which is discharged first, after the recording medium discharged first is supported by the discharge tray and before a recording medium which is subsequently discharged is supported by the discharge tray.

3. The image forming apparatus according to claim 1;

wherein the press down mechanism has a curved part which is curved upward and has an apex between the rotation center and the abutting surface; and wherein the curved part intersects with the conveying path when the recording medium is being pressed down.

4. The image forming apparatus according to claim 1, further comprising:

a stopper which is disposed to contact the press down mechanism when the press down mechanism rotates away from the recording medium supported by the discharge tray.

5. The image forming apparatus according to claim 1, further comprising:

a moving mechanism configured to vertically move the supporting surface of the discharge tray.

6. The image forming apparatus according to claim 1;

wherein a length from the center of gravity of the press down mechanism to the rotation center is shorter than a length from the center of gravity of the press down mechanism to the abutting surface.

7. The image forming apparatus according to claim 1;

wherein the abutting surface is a curved surface.

8. The image forming apparatus according to claim 1;

wherein the abutting surface contacts with an upstream end in the discharge direction of the upper surface, and an angle formed by the abutting surface and the upper surface is an acute angle.

9. The image forming apparatus according to claim 3;

wherein the apex between the rotation center and the abutting surface is vertically above a linear line connecting the rotation center with the abutting surface.

10. The image forming apparatus according to claim 5, further comprising:

a motor which is configured to drive the moving mechanism.

11. The image forming apparatus according to claim 1;

wherein the abutting surface is curved to protrude downward.

12. The image forming apparatus according to claim 1, further comprising:

at least a second ejection roller pair in addition to the ejection roller pair;

wherein at least two roller shafts of ejection rollers, which are included in the ejection roller pairs and are vertically below the conveying path, are distanced from one another in a direction orthogonal to the discharge direction to form a gap between the at least two roller shafts, so as to avoid interference with the press down mechanism rotating about the rotation center.

13. An image forming apparatus comprising:

a discharging slot configured to allow the discharge of a recording medium on which an image is formed;

a discharge tray which includes a supporting surface configured to support the recording medium discharged from the discharging slot;

a discharge mechanism configured to discharge the recording medium to the discharge tray through the discharging slot;

a press down mechanism comprising:

one press down part including an abutting surface configured to press down an upper surface of the recording medium when the recording medium is supported by the supporting surface of the discharge tray; and at least two arms connected to the one press down part; and a stopper which is disposed to contact the press down mechanism when the press down mechanism rotates away from the recording medium supported by the discharge tray;

wherein the discharge mechanism includes:

a conveying path for conveying the recording medium toward the discharging slot;

an ejection roller pair which is configured to sandwich the recording medium and eject the recording medium through the discharging slot; and a guide that constitutes a lower surface of the conveying path and supports a lower surface of the recording medium;

wherein the press down mechanism is rotatable about a rotation center provided vertically above the conveying path and upstream of the discharging slot in a discharge direction in which the recording medium is discharged from the discharging slot;

wherein the abutting surface contacts with the supporting surface when no recording medium is supported by the discharge tray;

wherein each arm of the press down mechanism extends from the rotation center to reach the one press down part, and includes a leading end that is connected to the one press down part;

wherein the one press down part uninterruptedly extends from one end to an other end of the supporting surface of the discharge tray in a direction that is parallel to a width direction of the recording medium supported by the supporting surface of the discharge tray and is orthogonal to the discharge direction;

wherein each arm intersects with a part of the conveying path, which part is upstream of the discharging slot, when the press down mechanism presses down the recording medium;

wherein at least one notch is formed in the guide so that the guide does not interfere with the arms when the one press down part presses down the upper surface of the recording medium supported by the supporting surface of the discharge tray; and wherein the stopper is a roller shaft of an ejection roller which is included in the ejection roller pair, and is positioned vertically above the conveying path.

14. An image forming apparatus comprising:

a discharging slot configured to allow the discharge of a recording medium on which an image is formed;

a discharge tray which includes a supporting surface configured to support the recording medium discharged from the discharging slot;

a discharge mechanism configured to discharge the recording medium to the discharge tray through the discharging slot; and a press down mechanism comprising:

a press down part including an abutting surface configured to press down an upper surface of the recording medium when the recording medium is supported by the supporting surface of the discharge tray; and an arm connected to the press down part;

wherein the discharge mechanism includes:

a conveying path for conveying the recording medium toward the discharging slot; and a guide that constitutes a lower surface of the conveying path and supports a lower surface of the recording medium;

wherein the press down mechanism is rotatable about a rotation center provided vertically above the conveying path and upstream of the discharging slot in a discharge direction in which the recording medium is discharged from the discharging slot;

wherein the abutting surface contacts with the supporting surface when no recording medium is supported by the discharge tray;

wherein the arm of the press down mechanism extends from the rotation center to reach the press down part, and intersects with a part of the conveying path, which part is upstream of the discharging slot, when the press down mechanism presses down the recording medium;

wherein the discharging mechanism includes multiple ejection roller pairs which are each configured to sandwich the recording medium and eject the recording medium through the discharging slot;

wherein at least two roller shafts of ejection rollers, which are included in the ejection roller pairs and are vertically below the conveying path, are distanced from one another in a direction orthogonal to the discharge direction to form a gap between the at least two roller shafts, so as to avoid interference with the press down mechanism rotating about the rotation center;

wherein, when rotating, the arm of the press down mechanism passes through the gap between the at least two roller shafts; and wherein a notch is formed in the guide so that the guide does not interfere with the arm when the press down part presses down the upper surface of the recording medium supported by the supporting surface of the discharge tray.

15. The image forming apparatus according to claim 14;

wherein the at least two roller shafts are coaxial so as to be arranged on a single virtual straight line through which the arm of the press down mechanism passes when the arm rotates.

* * * * *